US005203246A

United States Patent [19]

Smitterberg et al.

[11] Patent Number: 5,203,246

[45] Date of Patent: Apr. 20, 1993

[54] SYSTEM TO ALIGN AND SQUARE BOXES

[75] Inventors: Dean W. Smitterberg; Timothy C. Prochnow; William R. Nachtrab, Jr., all of Phillips, Wis.

[73] Assignee: Marquip, Inc., Phillips, Wis.

[21] Appl. No.: 873,380

[22] Filed: Apr. 24, 1992

[51] Int. Cl.[5] ..... B65H 9/00

[52] U.S. Cl. ..... 83/420; 83/421; 83/435.2; 83/447; 83/449; 271/240

[58] Field of Search ..... 83/449, 420, 421, 418, 83/435.2, 446, 88, 732, 450, 447; 271/240, 250; 198/456

[56] References Cited

U.S. PATENT DOCUMENTS

| | | | |
|---|---|---|---|
| 2,528,106 | 3/1950 | Albrecht | 271/240 |
| 3,768,101 | 10/1973 | Kuts | 83/420 X |
| 3,854,315 | 12/1974 | Winkler | 271/250 X |
| 4,381,108 | 4/1983 | Newsome | 271/240 X |
| 4,919,414 | 4/1990 | Marschke et al. | 271/227 |
| 5,090,281 | 2/1990 | Paulson et al. | 83/13 |

*Primary Examiner*—Frank T. Yost
*Assistant Examiner*—Kenneth E. Peterson
*Attorney, Agent, or Firm*—Andrus, Sceales, Starke & Sawall

[57] ABSTRACT

A system for aligning and squaring folded and glued boxes being conveyed serially in line or in a shingle utilizes a fixed set of alignment wheels positioned parallel to and on one side of the shingle and a set of adjustable alignment wheels positioned on the opposite lateral edge of the shingle. The adjustable alignment wheels can be adjusted as a unit to pivot on a vertical axis and to move laterally slightly into the path of the shingle. The pivot arm on which the adjustable wheels are mounted accommodates major misalignment of the initially incoming shingle, but is pivoted to an aligned position in the direction of shingle movement by the force of the moving shingle. Return of the pivot arm to the aligned position activates an air cylinder to move the alignment wheels laterally into the edge of the shingle with a force sufficient to move the boxes into engagement with the fixed alignment wheels on the opposite side, thereby providing complete edge registration of the boxes in the shingle and simultaneously squaring any boxes which may have become out of square before the glue has dried. The registration system is positioned immediately upstream of a rotary slitting blade into which the shingle is conveyed. A secondary alignment mechanism of substantially shorter length, but operating similarly to the primary upstream mechanism, helps retain accurate alignment during slitting. Spring biased holddown strips are positioned above the shingle to provide a vertical holddown force, which force progressively increases in a downstream direction to allow easy lateral movement of the boxes in the main registration mechanism, but a greater holddown force at the slitting blade.

10 Claims, 6 Drawing Sheets

SYSTEM TO ALIGN AND SQUARE BOXES

BACKGROUND OF THE INVENTION

The present invention relates to a system for providing accurate edge alignment of boxes being conveyed sequentially or in a shingled configuration and, more particularly, to a system for simultaneously squaring and aligning a moving line or a shingle of knocked down corrugated paperboard boxes for accurate longitudinal slitting.

In accordance with the current state of the art, corrugated paperboard running in a continuous web or sheet is most commonly slit in a longitudinal direction by running the board through a slitting nip formed by a pair of overlapping upper and lower blades which operate in a shear-type mode to provide a continuous slit. Such shear-type slitting techniques work satisfactorily for standard single thickness corrugated paperboard sheets, but slit quality deteriorates rapidly with double and triple wall sheet and when slitting multiple layers, such as may be encountered in a folded and glued container, sometimes referred to as a knocked down box.

More recently, the assignee of the present invention has developed alternate slitting apparatus and methods which overcome the thickness limitations inherent in shear-type slitting and, therefore, provide means for slitting not only multi-layer paperboard products, but also slitting a shingle of overlapping sheets of corrugated board. In particular, U.S. Pat. No. 5,165,314, entitled "Slitting Shingled Sheets" filed on Sep. 20, 1991, and U.S. Pat. No. 5,158,522, entitled "Slitting Corrugated Paperboard Boxes, filed on Sep. 20, 1991, both of which are commonly owned with the invention described and claimed herein, describe methods and apparatus for accurately and efficiently slitting knocked down corrugated boxes being conveyed in a shingle. Such shingle slitting techniques provide potentially great benefits to the corrugated paperboard box industry by allowing high speed and accurate slitting which is impossible with prior art shear-type slitters, eliminating many intermediate processing steps necessary by the limitations inherent in prior art slitting, and expanding significantly the productivity of a flexo-folder-gluer in which corrugated boxes are made.

Nevertheless, when slitting a shingle of knocked down corrugated boxes, particularly immediately after the boxes are discharged from the flexo-folder-gluer, the maintenance of accurate alignment of the boxes in the shingle is critically important as the shingle is moved into the unitary high speed slitting blade disclosed in the above identified applications. In addition, before the glue has set on the knocked down boxes, the boxes are sometimes subject to so-called "fish tailing" manifested by a loss of square because of slipping of the glued tabs on the overlapping box surfaces to which they are attached. If the shingle is not in accurate alignment, i.e. if the lateral edges of the boxes forming the shingle are not accurately aligned in a vertical plane, or if some of the boxes in the shingle are not square, the subsequent longitudinal slitting of the shingle will result in dimensional inaccuracies and the generation of scrap. Even if knocked down corrugated boxes are not shingled for slitting, but instead conveyed serially in a line, box alignment and square must still be maintained for the slitting operation which follows.

SUMMARY OF THE INVENTION

In accordance with the present invention, a system is provided for simultaneously aligning and squaring the knocked down boxes which are being conveyed into a slitter. The system operates to simultaneously provide accurate edge alignment of the boxes and to square any box edges which have fish tailed after discharge from the flexo.

The apparatus of the present invention is positioned directly over the conveyor and on each side of the line of boxes or the shingle being conveyed thereon. The apparatus includes a plurality of fixed alignment wheels positioned on one side of the conveyor to engage the edges of the boxes in a vertical plane that defines one lateral edge of the line of boxes. A plurality of primary adjustable alignment wheels are mounted as a unit to pivot about a vertical axis and to move laterally with respect to the line of boxes. The primary adjustable alignment wheels are adapted to move into engagement with the edges of the boxes opposite the fixed alignment wheels in a vertical plane defining the other edge of the line of boxes. Means are also provided for biasing the primary adjustable alignment wheels to pivot the wheels out of the vertical plane defining the opposite edge of the boxes and to initially position the downstream-most of the primary alignment wheels in the path of shingle movement to initially wedge the boxes into the system. Means are provided for applying a lateral biasing force to the primary alignment wheels, which force is sufficient to move the edges of the boxes into engagement with the fixed alignment wheels on the opposite side of the shingle. The lateral biasing means is responsive to pivotal movement of the primary adjustable alignment wheels from their initial non-aligned position with respect to the boxes into the vertical plane defining the adjacent edge of the line of boxes.

The apparatus includes means for applying a vertical downward force to the upper surface of the boxes to assist in retaining the relative positions of the boxes, whether being conveyed singly or in the shingle, the downward force being applied between the fixed and primary adjustable alignment wheels. The vertical downward holding force is preferably applied in a manner to progressively increase the force in the downstream direction. Means for slitting the shingle, such as a unitary high speed rotary blade, is positioned at the downstream end of the primary adjustable alignment wheels in a position to receive the fully aligned and squared boxes.

In the preferred embodiment, the apparatus is especially adapted to handle shingled boxes and includes a plurality of secondary adjustable alignment wheels which are generally aligned with and located downstream of the primary alignment wheels, the secondary wheels being positioned laterally adjacent the slitting means and opposite the downstream end of the fixed alignment wheels. The secondary alignment wheels are adapted to move as a unit into engagement with the edges of the boxes in the shingle and means are provided for applying a lateral biasing force to the secondary wheels simultaneously with the lateral biasing force applied to the primary adjustable alignment wheels, which force is sufficient to maintain the edges of the boxes in engagement with the opposite fixed alignment wheels. The secondary adjustable alignment wheels are also preferably mounted to pivot about a vertical axis, and means are provided for biasing the secondary wheels to pivot as a unit to initially position the upstream-most of the secondary wheels out of the path of incoming shingle movement.

DETAILED DESCRIPTION OF THE PREFERRED EMBODIMENT

The preferred embodiment of the invention will be described for use in aligning and squaring boxes which are being conveyed in a shingle. However, the system may be used as well for aligning and squaring boxes moving serially or sequentially in line which are not shingled.

Figure 1:
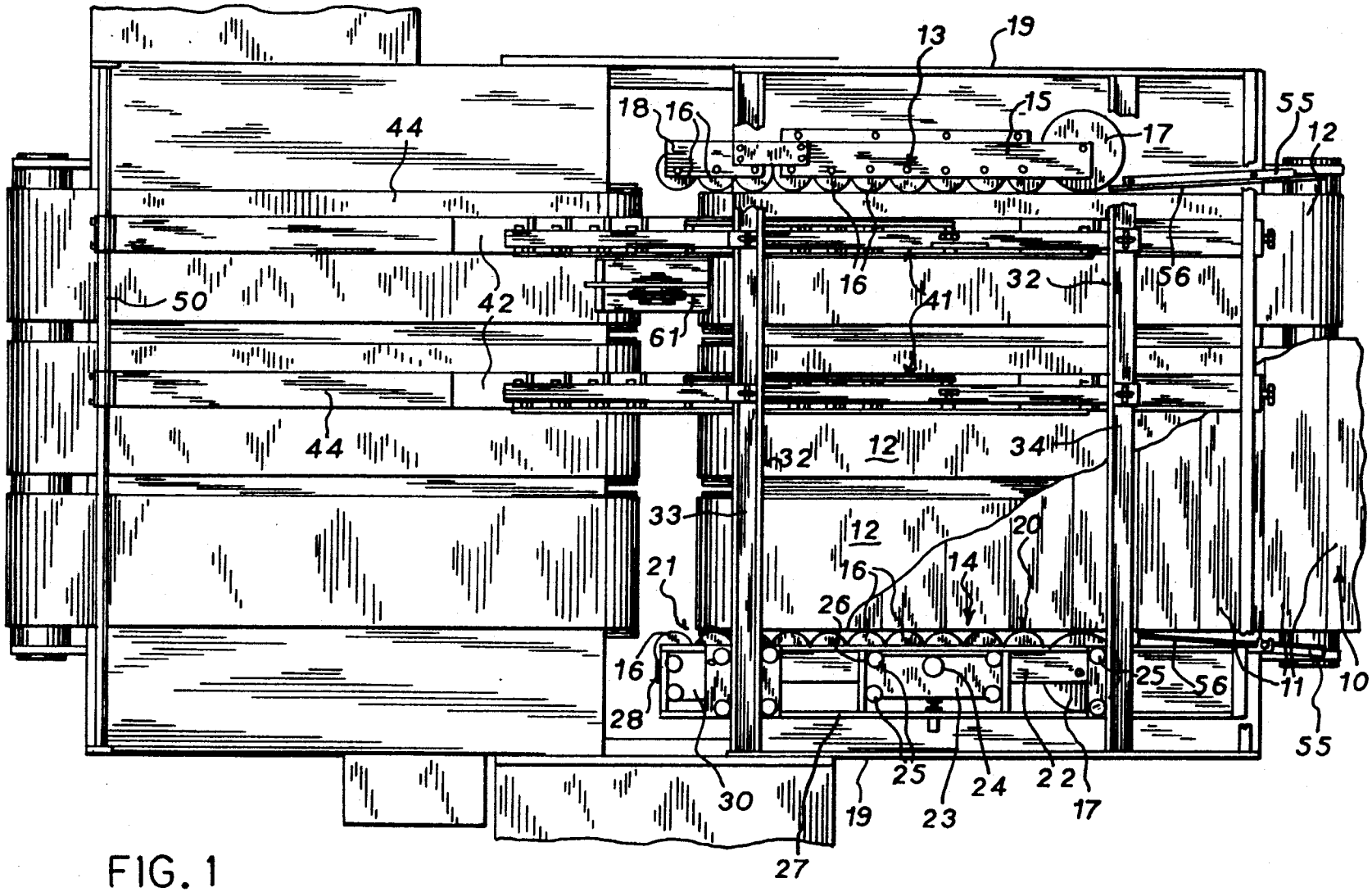
FIG. 1 is a top plan view of the apparatus of the present invention combined with means for slitting a shingle traveling therethrough.
Figure 2:
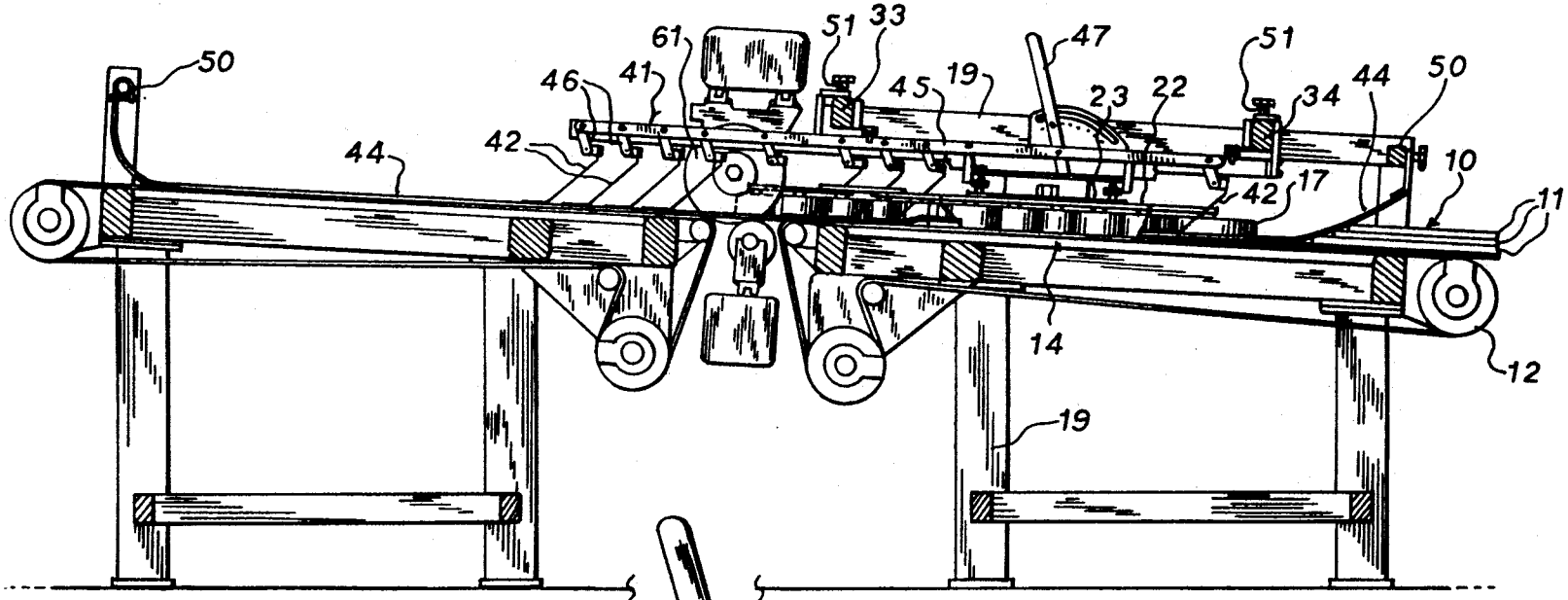
FIG. 2 is a side elevation of the apparatus shown in FIG. 1.

Referring initially to FIGS. 1 and 2, t he apparatus of the present invention is adapted to handle a moving shingle 10 comprising a series of knocked down boxes 11, the latter having been printed, folded and glued in a flexo-folder-gluer (sometimes referred to as a "flexo"). The shingle 10 may be formed directly from boxes exiting the flexo or the boxes may be first reoriented and/or stacked or otherwise processed before shingling. In any event, the ability to longitudinally slit the boxes while in a shingled configuration substantially simplifies box handling and processing and, in addition, maintaining the boxes in a shingled configuration utilizes the stacking weight of the overlapping boxes to assist in maintaining box square while the glue dries. The shingle may be composed of large regular slotted containers which are subsequently slit to form two lines of half slotted containers, or the shingle may be composed of special regular slotted containers made to provide two lines of half-size regular slotted containers when slit medially in the longitudinal direction. A more detailed discussion of the configuration and slitting of such containers or knocked down boxes is set forth in the two above identified applications.

Figure 3:
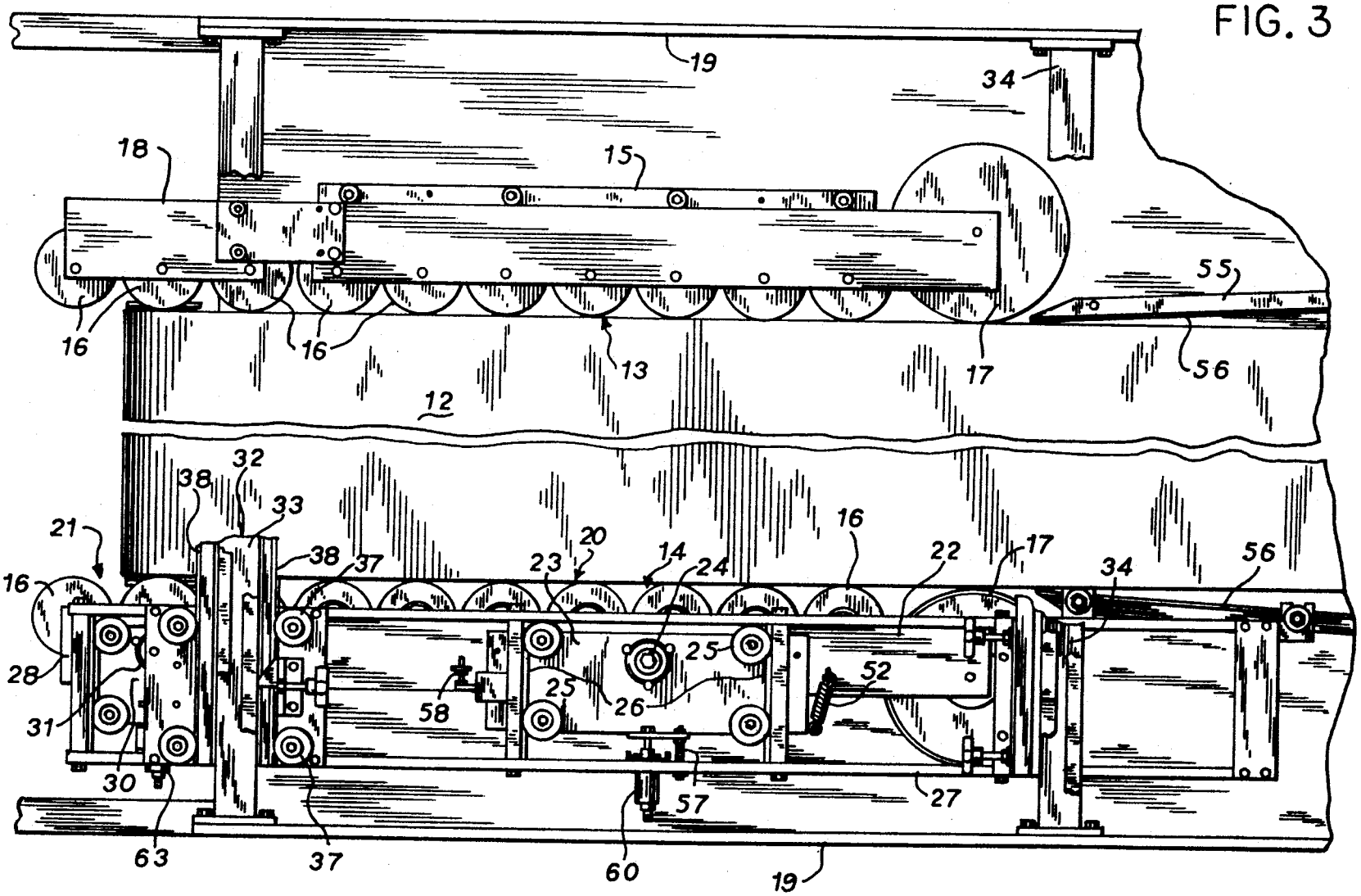
FIG. 3 is a top plan view of details of the registration system of the present invention.
Figure 4:
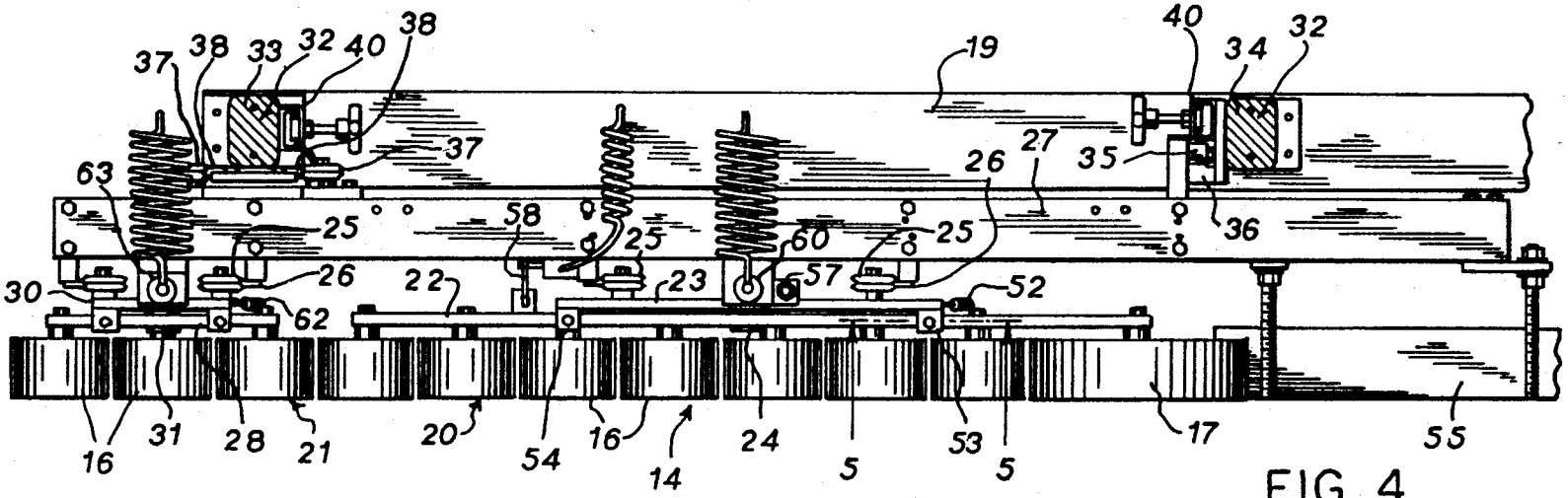
FIG. 4 is a side elevation of the apparatus shown in FIG. 3.

The shingle is supported on and carried by a belt conveyor 12 or a series of parallel belt conveyors 12. Registration of the knocked down boxes 11 in the shingle 10 and simultaneous squaring of any misaligned boxes is provided by incrementally shifting the boxes in the shingle and guiding them between a set of fixed alignment wheels 13 on one side of the conveyor and a set of adjustable alignment wheels 14 on the other side of the conveyor. Referring also to FIGS. 3 and 4, the fixed set of alignment wheels 13 is mounted to one side of and with the lower edges of the wheels slightly below the edge of the belt conveyor 12. The adjustable alignment wheels 14 are supported just above the surface of the conveyor(s). Each of the wheels in each set is mounted for rotation in response to contact by one edge of the moving shingle 10. Each of the fixed alignment wheels 13 is rotatably attached to and depends downwardly from a fixed support arm 15 which is, in turn, mounted above the floor on the vertical members of the supporting framework 19 (see FIG. 2). The set includes a plurality of small diameter wheels 16 of which there are ten in the embodiment shown and a single large diameter wheel 17 positioned at the upstream end of the set 13. The centers of the small diameter wheels 16 are aligned in the direction of conveyor and shingle movement and the center of the large diameter wheel 17 is offset laterally outwardly so that the outer peripheral surfaces of the wheels 16 and 17 directly adjacent the shingle 10 are commonly tangent to a fixed vertical plane parallel to the direction of shingle movement. The three downstream-most small wheels 16 may be attached to a separate short fixed support arm 18 which can be temporarily removed to allow an additional slitting blade (to be described) to be mounted in a stored position out of the path of box flow.

The set of adjustable alignment wheels 14 includes a plurality of primary adjustable wheels 20 and a separate plurality of secondary adjustable wheels 21 which together comprise a set 14 identical in size and number to the set of fixed alignment wheels 13. Thus, the primary adjustable alignment wheels 20 comprise seven small diameter wheels 16 and a large diameter wheel 17 on the upstream end. The secondary adjustable alignment wheels comprise three small diameter wheels. The center of the large diameter wheel 17 of the primary set 20 is offset outwardly from the centers of the small diameter wheel 16, in a manner similar to the set of fixed alignment wheels 13.

The primary adjustable alignment wheels 20 are each rotatably attached to a common primary pivot arm 22 such that the outer peripheral surface portions of the wheels 16 and 17 are commonly tangent to a vertical plane, which plane is subject to angular movement between a position parallel to the direction of shingle movement and a position disposed at an acute angle thereto.

The primary pivot arm 22 is pivotally attached to a primary carriage plate 23 by a central pivot 24 so as to roughly divide the set of primary adjustable alignment wheels 20 into an upstream set comprising three small diameter wheels 16 and the large diameter wheel 17, and a downstream set comprising four small diameter wheels 16. The primary carriage plate 23 is slidably mounted for reciprocal lateral movement on a line perpendicular to the direction of shingle movement by two oppositely disposed pairs of grooved cam wheels 25, each pair operating on a knife edge track 26, which tracks 26 are secured to the underside of a main longitudinal support arm 27. The primary adjustable alignment wheels 20 are thus capable of pivotal movement as a unit about the central pivot 24 and separate lateral movement as a unit toward and away from the adjacent edge of the shingle 10.

The secondary adjustable wheels 21 are rotatably attached to and depend downwardly from a secondary pivot arm 28 which, in turn, is pivotally attached to a secondary carriage plate 30 on a pivot 31. Pivot 31 is centered longitudinally on the secondary pivot arm 28. The second carriage plate 30 is also slidably attached to the main longitudinal support arm 27 with opposite pairs of grooved cam wheels 25 captured on respective knife edge tracks 26, all in a manner virtually identical to the slidable mounting of the primary carriage plate 23. Thus, the secondary adjustable alignment wheels 21 are subject to pivotal and linear lateral movement in a manner similar to the primary adjustable alignment wheels 20, but independently thereof.

The main longitudinal support arm 27 is supported for lateral sliding movement along a pair of main lateral supports 32 extending across the full width of the apparatus and attached by their respective opposite ends to the main frame 19. The upstream end of the support arm 27 is slidably attached to the upstream main lateral support 34 with a pair of cam wheels 35 riding on a rail 36. The downstream end of the main longitudinal support arm 27 is mounted for slidable movement along the downstream lateral support 33 by oppositely disposed pairs of grooved cam wheels 37, each pair of which is captured on an appropriate knife edge track 38 extending along substantially the full length of the lateral support 33. The attachment of each end of the main longitudinal support arm 27 to the respective downstream and upstream lateral supports 33 and 34 includes appropriate lockdown mechanisms 40 to set and hold the desired lateral distance between the fixed alignment wheels 13 and adjustable alignment wheels 14 about 1/16 to ⅛" (1.5 to 3 mm) less than the width of the shingle.

Figure 6:
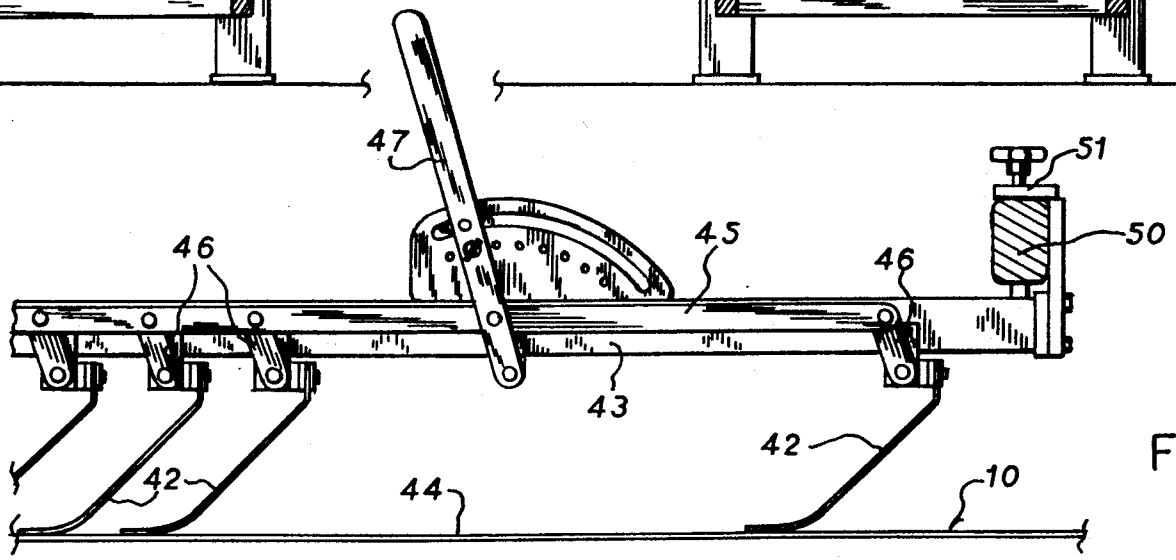
FIG. 6 is an enlarged detail of a portion of FIG. 2.

Referring particularly to FIGS. 1, 2 and 6, the apparatus of the present invention also includes a pair of upper holddown devices 41 positioned in spaced parallel arrangement above the conveyors 12, each of which includes a series of longitudinally spaced and forwardly angled spring fingers 42 depending downwardly from an upper support 43. The lower ends of the spring fingers 42 are commonly attached to a long narrow holddown strip 44 which bears directly against the upper surface of the shingle 10. The upper ends of the spring fingers 42 are pivotally attached to a horizontal support bar 45 by individual pivotal links 46. The support bar 45 is maintained horizontal but its position may be changed vertically with respect to the upper support 43 by moving the pivotal operating lever 47 and thereby varying the force which the spring fingers 42 exert on the holddown strip 44 and, thus, on the upper surface of the shingle 10. The holddown devices 41 are adjusted such that the holddown strips 44 exert a downward force of small enough magnitude to permit substantially unrestricted transverse shifting of the knocked down boxes 11 forming the shingle 10 under the influence of a lateral force imposed on the adjustable alignment wheels 14, in a manner which will be described hereinafter.

Each holddown device 41 is mounted for adjustable lateral positioning above the conveyors 12. The upper support 43 is slidably attached to the main lateral supports 32. The opposite ends of each holddown strip 44 are slidably mounted on cross members 50. Suitable manual locking devices 51 are used to secure each holddown device 41 in its selected position.

Figure 5:
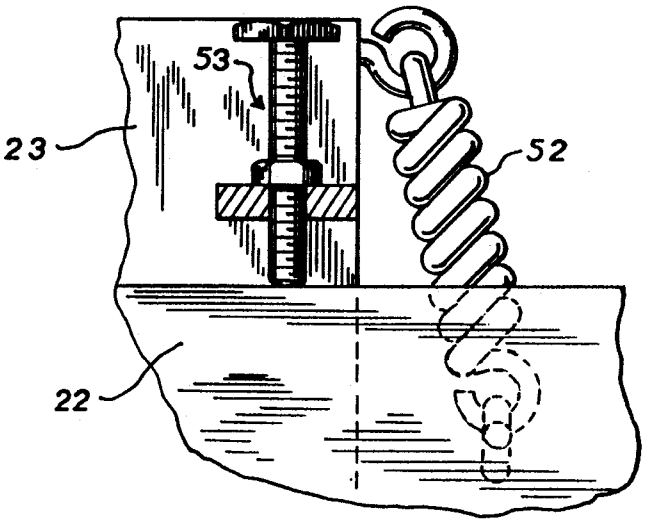
FIG. 5 is a detailed view, partly in section, taken on line 5—5 of FIG. 4.

Referring particularly to FIGS. 3, 4 and 5, a biasing pivot spring 52 interconnects one end of the primary carriage plate 23 and the primary pivot arm 22 to cause the pivot arm 22 to rotate about the central pivot 24 in a direction tending to pull the primary adjustable alignment wheels 20 which are upstream of the central pivot 24 out of the path of movement of the shingle 10, while simultaneously causing the primary adjustable alignment wheels 20 on the downstream end of the primary pivot arm 22 to move into the path of shingle movement. An adjustable pivot stop 53 is set to limit the amount of pivotal movement which need only be about 1°. Similarly, a downstream adjustable pivot stop 54 is set to allow return pivotal movement of the primary pivot arm 22 to an aligned position in which the primary adjustable alignment wheels 20 are tangent to a vertical plane parallel to the edge of the shingle. Thus, before the leading edge of the shingle 10 enters the system, the force of the biasing pivot spring 52 will hold the primary pivot arm 22 and the attached primary adjustable alignment wheels 20 in a non-aligned position where the wheels are tangent to a vertical plane which is not parallel to the edge of the shingle. The 1° pivot imparted to the pivot arm 22 will result in the large diameter wheel 17 being pulled about ¼ inch (about 7 mm) out of the path of the shingle and, correspondingly, the most-downstream small diameter wheel 16 to be moved into the path of the shingle by about the same amount.

A lead-in pan 55 is attached to the frame just upstream of each large diameter wheel 17 of the set of fixed alignment wheels 13. Another pan 55 is attached to and movable with the main support arm 27 for the adjustable alignment wheels 14. The lead-in pans have vertical planar surfaces 56 which are positioned to converge and lie in planes approximately tangent to the outer surface of the respective large diameter wheel 17 when the wheel is in its aligned position. The lead-in pans 55 are intended to provide initial contact surfaces for the leading end of the incoming shingle 10 to remove any major skew from individual boxes 11 or to remove any major parallel offset of boxes within the shingle.

A small biasing compression spring 57 is mounted between the main longitudinal support arm 27 and the carriage plate 23 to bias the carriage plate laterally inwardly and to carry the primary adjustable alignment wheels 20 attached thereto into the path of the shingle. The biasing compression spring 57 may be adjusted, for example, to normally hold the adjustment wheels 20 approximately 0.06 inches (1.5 mm) into the path of shingle movement when not in contact therewith. Recalling, however, that the biasing pivot spring 52 has caused the upstream primary alignment wheels 20 to be rotated out of the path of movement of the shingle, the large diameter wheel 17 and one or more of the upstream-most small diameters wheels 16 will not initially be contacted by the incoming shingle. Thus, the shingle may make initial contact with the primary adjustable alignment wheels 20 at one of the small diameter wheels 16 just upstream, or possibly even downstream, of the central pivot 24. As a result of initial shingle contact, the primary alignment wheels 20 will be wedged laterally outwardly against the force of the biasing compression spring 57 and, as the leading box in the shingle moves past the central pivot 24, the primary pivot arm 22 will rotate against the force of the biasing pivot spring 52 toward the aligned position parallel to the shingle and its direction of movement, and bring the upstream wheels 16 and 17 into contact with the shingle. Once the shingle is well into the primary alignment section and past the central pivot 24, the edges of the boxes 11 are substantially, but not completely aligned and in register. When the force of the moving shingle has caused the primary pivot arm 22 to rotate to the aligned position parallel to the edge of the shingle, a limit switch 58 is tripped, activating a high pressure pneumatic cylinder 60. The cylinder 60 is mounted on the main longitudinal support arm 27 adjacent the biasing compression spring 57 and has its extensible rod end attached to the carriage plate 23, such that actuation of the cylinder 60 drives the primary alignment wheels 20 into the adjacent edges of the boxes and forces the opposite edges against the fixed alignment wheels 13.

At this point the apparatus is operating in an equilibrium state with the box edges in registration, including the squaring of any boxes which may have been subject to fish tailing as a result of upstream handling. The shingle is directed toward and into a slitting blade 61 rotating at high speed and positioned just downstream of the downstream end of the secondary adjustable alignment wheels 21 as is best seen in FIGS. 1 and 2. In this state, the registered shingle which is also held vertically by the holddown devices 41 may be accurately slit on a continuing basis. However, the apparatus also provides a supplemental alignment means to help assure that the boxes near the slitting blade 61 do not shift laterally out of alignment should, for example, an overwidth box enter the system upstream and force the primary adjustable alignment wheels 20 laterally outwardly, resulting in a temporary gap between the wheels and the lateral edge of the shingle.

The second adjustable alignment wheels 21 are positioned laterally adjacent to the slitting blade 61 and directly opposite the three downstream-most wheels 16 of the set of fixed alignment wheels 13. The secondary biasing pivot spring 62 interconnects the secondary pivot arm 28 and its associated carriage plate 30 to normally bias the secondary pivot arm 28 slightly out of the aligned position parallel to the edge of the shingle, in a manner similar to that described with respect to the primary pivot arm 22. Thus, the biasing pivot spring 62 rotates the pivot arm 28 about the pivot 31 to pull the upstream wheel 16 out of the path of shingle movement and simultaneously move the downstream wheel 16 into the path of the shingle. The biasing of the secondary pivot arm 28 is particularly important when the shingle 10 is initially coming into the system so that the lead box in the shingle does not strike and be damaged by the upstream wheel 16 in the secondary alignment wheel set 21.

In a manner similar to the primary alignment mechanism, a secondary high pressure cylinder 63 is attached to the downstream end of the main longitudinal support arm 27 with its extensible rod end attached to the secondary carriage plate 30. The secondary cylinder 63 is adapted to operate simultaneously with the primary cylinder 60 in response to closing of the limit switch 58 to extend and hold the shingled boxes against the opposite fixed alignment wheels 13. However, because the primary upstream alignment mechanism has substantially registered and squared the boxes, they are essentially fully aligned when they reach the secondary alignment wheels 21 and no biasing compression spring similar to compression spring 57 is needed on the secondary unit.

Referring again to FIGS. 1 and 2, there are relatively fewer spring fingers 42 in the area adjacent the primary adjustable alignment wheels 20 and, therefore, a somewhat lower holddown force is imposed on the shingle in the region where the most lateral shifting of the boxes is likely to occur as a result of the lateral alignment forced imposed on the boxes by extension of the high pressure cylinder 60. On the other hand, the holddown force downstream in the area of the slitting blade 61 is increased by the use of more closely spaced spring fingers 42. This variation in the spring finger spacing and, thus the holddown force, permits relatively unrestricted lateral movement of the boxes in the area of primary registration, yet allows the shingle to be held more firmly as it enters the slitting blade adjacent the secondary alignment wheels 21.

Figure 7:
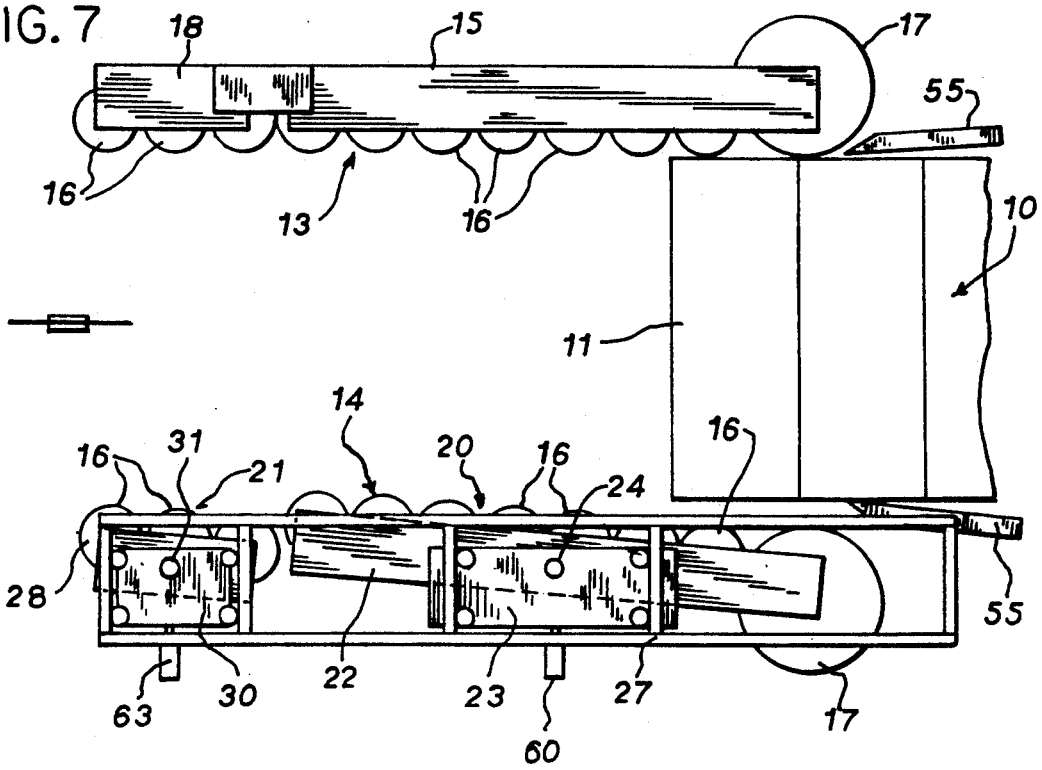
FIGS. 7-10 are schematic representations of the sequence of operation of the apparatus of the present invention.
Figure 8:
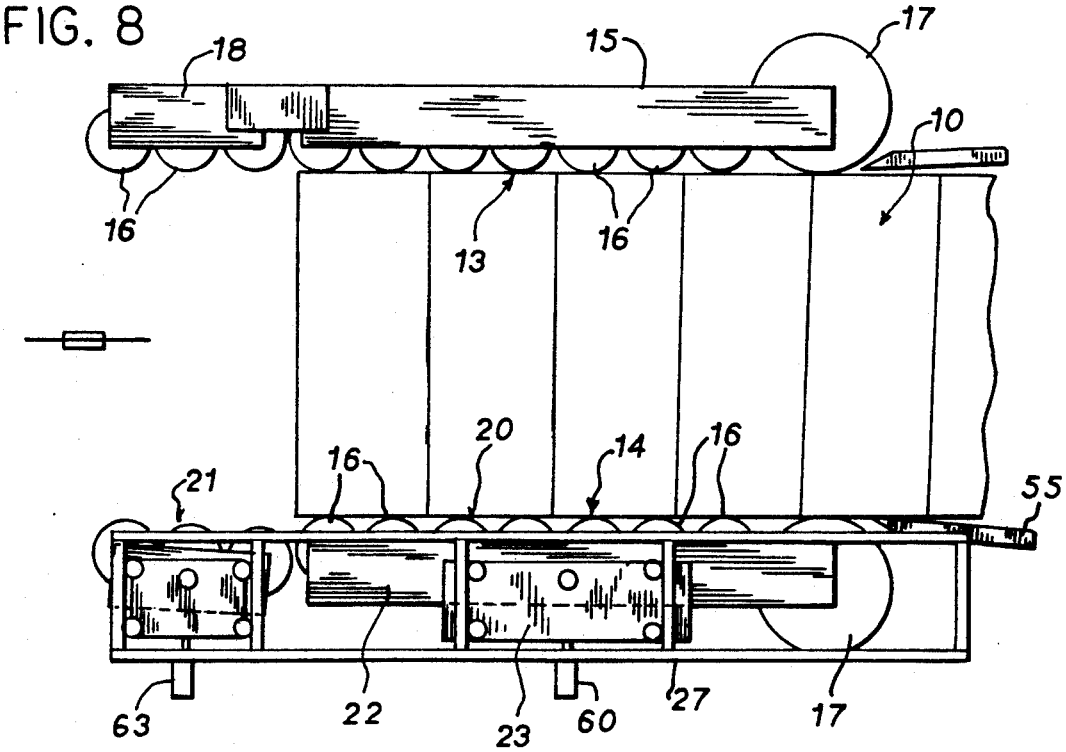
Figure 9:
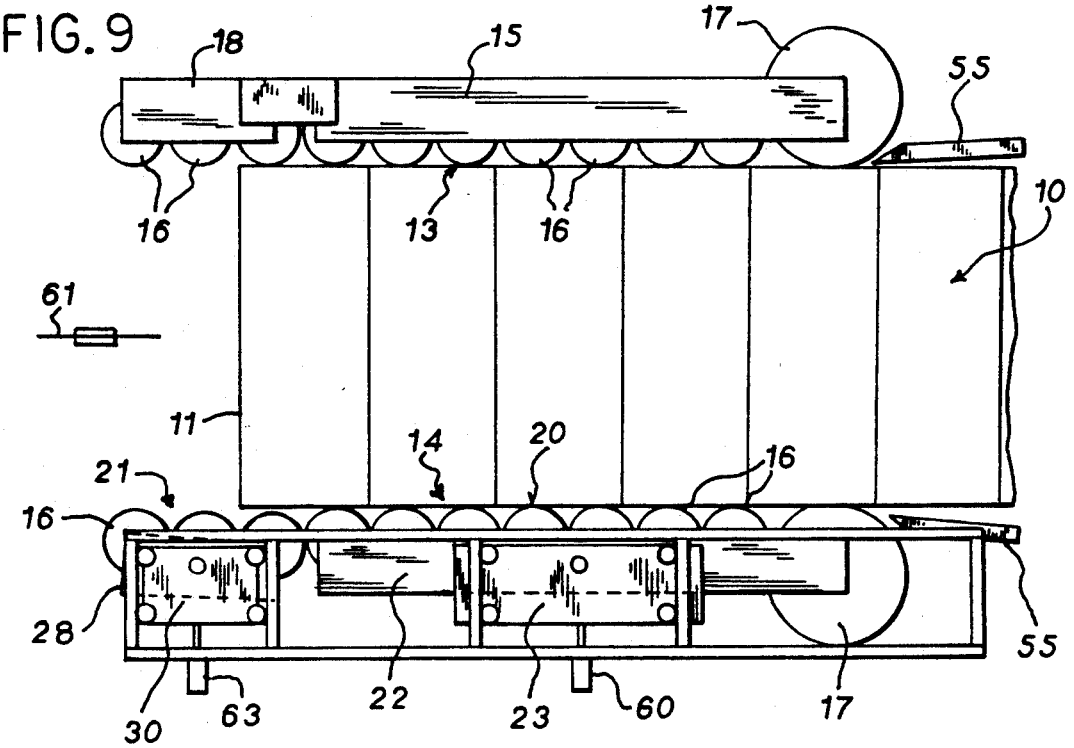
Figure 10:
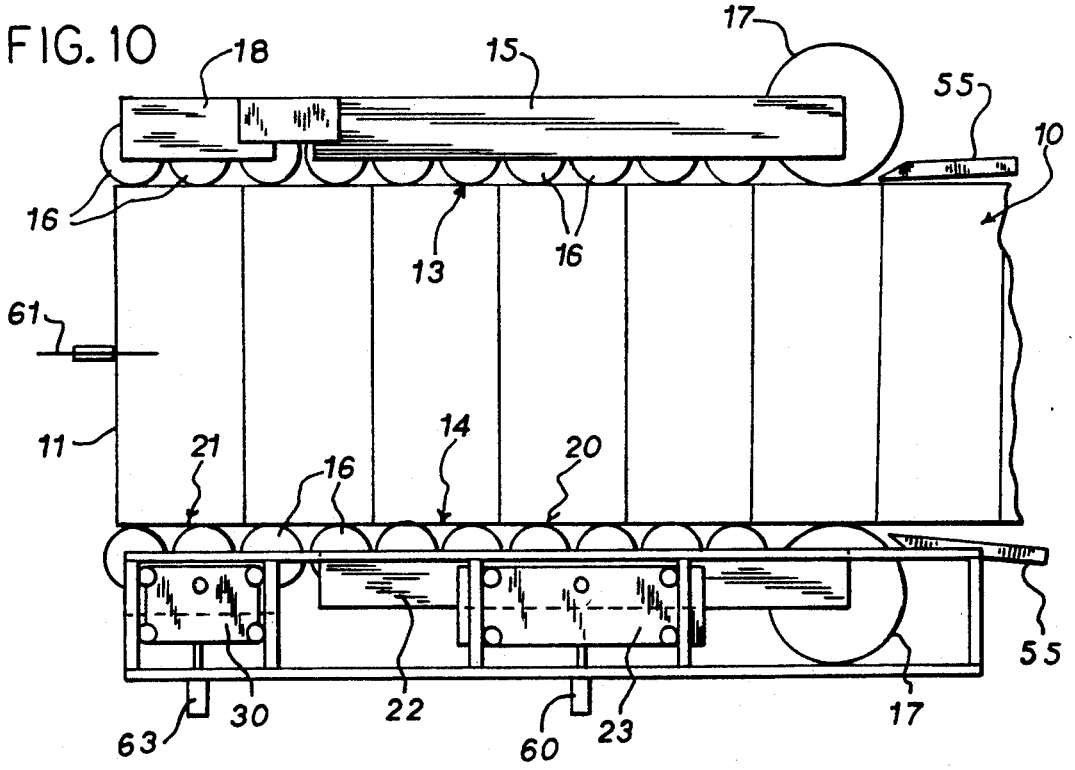

Referring to FIGS. 7–10, the operation of the apparatus of the present invention may be briefly summarized as follows. As shown in FIG. 7, the incoming shingle is guided into the space between the fixed alignment wheels 13 and adjustable alignment wheels 14 by the lead-in pans 55 which remedy any gross misalignment of boxes. The primary pivot arm 22 is biased to the non-aligned position with the large wheel 17 and one or more of the next adjacent small diameter wheels 16 pivoted out of the path of shingle movement. The remaining small diameter downstream wheels 16 are pivoted into the path of shingle movement, the upstream-most of which is initially engaged by the lead box 11 in the incoming shingle 10. The moving shingle will simultaneously cause rotation of the primary pivot arm 22 toward the aligned position parallel to board flow, as shown in FIG. 8, and lateral outward movement of the pivot arm and carriage plate 23 against the low level biasing force of the compression spring 57. When the pivot arm 22 reaches the fully aligned position, limit switch 58 is closed and cylinders 60 and 63 are extended under a high pressure air supply (e.g. 20–50 psi) to force the carriage plate and attached pivot arm 22 and primary alignment wheels 20 against the lateral edge of the shingle, thereby forcing the boxes against the opposite fixed alignment wheels 13 and registering the opposite edges thereof in vertical planes parallel to the direction of movement, as shown in FIG. 9. The secondary alignment wheels 21 have already been extended on their pivot arm 28 by extension of the secondary cylinder 63, but remain non-aligned under the bias of pivot spring 62 until the wheels 21 are engaged by the advancing shingle. The initial pivoted position of the secondary alignment wheels prevents damage to the edge of the lead box in the shingle, but the secondary pivot arm 28 is quickly moved to the aligned position under the influence of the moving shingle to hold the shingle securely in register directly adjacent the slitting blade 61, as shown in FIG. 10.

When an order is complete and the tail end of the shingle 10 has cleared the downstream-most wheel 16 of the primary alignment wheel set 20, the biasing pivot spring 52 will cause the primary pivot arm 22 to rotate to the non-aligned position, causing limit switch 58 to open and the pressure supply to cylinders 60 and 63 to be terminated. However, a slight delay is provided between opening the limit switch and the cutoff of pressure to the cylinders in order to allow the shingle to fully clear the slitter and the system before the secondary cylinder 63 is retracted. The cylinders 60 and 63 are single acting and utilize internal bias springs to retract the rods when pressure is relieved. The system is thus automatically returned to its initial position to await entry of the next shingle, after any width adjustments are made if necessary.

In lieu of the biasing compression spring 57, the high pressure cylinder 60 could be provided with a two stage pressure regulator providing an initial low stage pressure level to provide the initial biasing normally provided by the compression spring 57. Operation of the limit switch 58 would raise the pressure applied to the cylinder to the second high level to provide the final squaring force. The secondary cylinder 63 would be responsive only to operation of the limit switch and the application of the high operating pressure.

Various modes of carrying out the present invention are contemplated as being within the scope of the following claims particularly pointing out and distinctly claiming the subject matter which is regarded as the invention.

We claim:

1. An apparatus for aligning and squaring an advancing line of knocked down boxes on a conveyor, said boxes moving in a path from an upstream position to a downstream position and having edges, opposite edges and upper surfaces, said apparatus comprising:

a plurality of fixed alignment wheels positioned to engage the edges of the boxes in a vertical plane defining a lateral edge of the line of boxes;

a plurality of primary adjustable alignment wheels mounted as a unit to move into engagement with the opposite edges of the boxes in a vertical plane defining an opposite lateral edge of the line of boxes, said adjustable wheel unit adapted to pivot about a vertical axis and to move laterally with respect to the line of boxes;

means for biasing said primary adjustable wheel unit to pivot about said vertical axis out of said vertical plane to initially position the downstream-most of said primary adjustable wheels in the path of box movement;

means responsive to pivotal movement of said primary adjustable wheels from said initial position into said vertical plane for applying a lateral biasing force to said primary adjustable wheel unit sufficient to move the edges of the boxes into engagement with said fixed alignment wheels.

2. The apparatus as set forth in claim ¼ 1 including means for applying a vertical downward force to the upper surfaces of the boxes between said fixed and adjustable alignment wheels.

3. The apparatus as set forth in claim 2 including means for slitting the boxes positioned downstream of the primary adjustable alignment wheels.

4. The apparatus as set forth in claim 3 wherein said vertical downward force is applied to increase in the downstream direction.

5. The apparatus as set forth in claim 2 comprising:

a plurality of secondary adjustable alignment wheels generally aligned with and downstream of said primary adjustable alignment wheels, said secondary wheels positioned laterally of said slitting means and opposite the downstream-most of said fixed alignment wheels to move as a unit into engagement with said opposite edges of the boxes;

means for applying a lateral biasing force to said secondary wheels simultaneously with the lateral biasing force applied to said primary adjustable alignment wheels sufficient to maintain the edges of the boxes in engagement with said fixed alignment wheels.

6. The apparatus as set forth in claim 5 including means for pivotally mounting said secondary wheels to pivot about a second vertical axis, and means for biasing said secondary wheels to pivot as a unit about said second axis to initially position the upstream-most of said second wheels out of the path of box movement.

7. An apparatus for aligning and squaring a line of knocked down boxes being moved in a linear path on a moving conveyor, said boxes having edges, opposite edges and upper surfaces, said apparatus comprising:

a plurality of fixed alignment wheels positioned along one lateral edge of the conveyor and having outer peripheral surface portions commonly tangent to a fixed vertical plane parallel to the direction of conveyor movement, said surface portions adapted to engage the edges of the boxes on a lateral edge of the line of boxes;

a plurality of primary adjustable alignment wheels positioned along and above the conveyor and adjacent an opposite lateral edge of the line of boxes, said primary adjustable alignment wheels having outer peripheral surface portions commonly tangent to an angularly variable vertical plane including a plane defining said other lateral edge of the boxes;

a rigid pivot arm carrying said primary adjustable alignment wheels, said pivot arm having a generally central pivot defining an upstream set of adjustable alignment wheels and a downstream set of adjustable alignment wheels;

a carriage plate mounted above the conveyor and to which said pivot arm is attached by the central pivot for pivotal movement on a vertical axis between an initial non-aligned position with the upstream wheel set generally out of the path of movement of the boxes the downstream wheel set generally in the path of movement of the boxes, and an aligned position with both the upstream and downstream wheel sets tangent to a vertical plane parallel to the path of box movement;

said carriage plate mounted for reciprocal movement perpendicular to the path of box movement;

means for biasing said pivot arm to the non-aligned position;

means for applying a first biasing force to said carriage plate to move said primary adjustable alignment wheels into the path of box movement;

means responsive to pivotal movement of said pivot arm to the aligned position for applying a second biasing force to said carriage plate sufficient to cause said adjustable alignment wheels to move the edges of the boxes into engagement with said fixed alignment wheels.

8. The apparatus as set forth in claim 7 comprising:

a plurality of secondary adjustable alignment wheels generally aligned with and positioned downstream of said primary adjustable alignment wheels;

means mounting said secondary wheels as a unit for rotation about a second vertical axis and for reciprocal movement perpendicular to the path of box movement;

means for rotatably biasing said secondary wheels about said second vertical axis to initially position at least the upstream-most of said secondary wheels out of the path of box movement; and, means responsive to pivotal movement of said pivot arm to the aligned position for biasing said second alignment wheels into contact with the edges of the boxes to hold the opposite edges of the boxes in contact with the downstream-most of said fixed alignment wheels.

9. The apparatus as set forth in claim 8 comprising:

holddown means for applying a vertical downward force to the upper surfaces of the boxes;

said downward force varying from a minimum at the upstream end of the apparatus to a maximum at the downstream end.

10. The apparatus as set forth in claim 9 including means for longitudinally slitting the boxes, said slitting means positioned laterally between the downstream end of the secondary adjustable alignment wheels and the downstream end of said fixed alignment wheels.

* * * * *